United States Patent [19]

Still et al.

[11] 4,050,992

[45] Sept. 27, 1977

[54] HOUSING CONSTRUCTION EXTENDING OVER THE COKE DISCHARGE AREA OF A HORIZONTAL COKE OVEN BATTERY

[75] Inventors: Carl Otto Still, Recklinghausen, Germany; Walter Dean Aust, Pittsburgh, Pa.

[73] Assignee: Firma Carl Still, Germany

[21] Appl. No.: 618,006

[22] Filed: Sept. 30, 1975

[30] Foreign Application Priority Data

Oct. 2, 1974 Germany ..... 2446987

[51] Int. Cl.[2] ..... C10B 33/00; C10B 39/08

[52] U.S. Cl. ..... 202/227; 202/263

[58] Field of Search ..... 202/262, 263, 227

[56] References Cited

U.S. PATENT DOCUMENTS

| | | | |
|---|---|---|---|
| 3,652,403 | 3/1972 | Knappstein et al. | 202/263 X |
| 3,715,282 | 2/1973 | Pries et al. | 202/227 X |
| 3,716,457 | 2/1973 | Schon | 202/227 X |
| 3,721,609 | 3/1973 | Spindeler | 202/263 X |
| 3,809,619 | 5/1974 | Drebes et al. | 202/227 X |
| 3,809,622 | 5/1974 | Knappstein et al. | 202/227 X |
| 3,844,901 | 10/1974 | Roe et al. | 202/227 X |
| 3,879,267 | 4/1975 | Nashan et al. | 202/227 X |
| 3,930,961 | 1/1976 | Sustarsic et al. | 202/227 |

*Primary Examiner*—Morris O. Wolk
*Assistant Examiner*—Arnold Turk
*Attorney, Agent, or Firm*—McGlew and Tuttle

[57] ABSTRACT

A housing structure for use with a coke oven battery having a plurality of horizontally arranged ovens with a master gangway extending horizontally alongside the battery and which is provided with a trackway thereon along which a coke cake guide car is movable comprises a housing having a roof which extends outwardly from the gangway. The housing roof structure is located above the height of the coke cake guide car and also overlies a conveyor for the coke which extends alongside the battery adjacent the gangway. The conveyor in most instances is a quenching car or a belt conveyor. The housing structure has a plurality of longitudinally spaced openings corresponding in dimensions and locations to the coke oven openings. The housing also includes an arrangement for the offtake of gas and dust.

5 Claims, 7 Drawing Figures

HOUSING CONSTRUCTION EXTENDING OVER THE COKE DISCHARGE AREA OF A HORIZONTAL COKE OVEN BATTERY

FIELD AND BACKGROUND OF THE INVENTION

This invention relates in general to the construction of coke oven batteries and, in particular, to a new and useful closed structure for use in the discharge area for hot glowing coke.

DESCRIPTION OF THE PRIOR ART

A known structure for use with coke oven batteries includes a roof structure equipped with gas and dust offtake system and which covers the coke-cake guide zone as well as the quenching car or conveyor belt, for removing the red hot coke from the horizontal coke oven batteries. The known structure includes a roofing designed as a closed hall extending over the entire length of the battery and enclosing the doors of the oven chambers and is connected to the quenching tower. One of the longitudinal walls of such a structure is formed on the coke side of the battery itself. It has become usual in the art to designate such structures as "quenching track halls", and such halls have been used very frequently in recent times.

The gases and dusts which develop or occur during the discharge of the incandescent coke from the coke oven chambers and during the breaking of the coke cake and the dumping of the coke into the quenching car or the movement of the coke on a conveyor belt are evacuated by means of the installed dust offtake system of the roof structure and the gases are cleaned in filtering devices and scrubbers prior to their discharge into the free atmosphere. However, the personnel operating these devices on the wharf in front of the battery become exposed to the unpurified gases and dust and, in addition, to the heat of the red hot coke.

SUMMARY OF THE INVENTION oven

The present invention provides a housing structure or quenching track hall which provides an improved structure from the standpoint of the working and personnel conditions in the vicinity of the coke oven batteries. In accordance with a feature of the invention, the roofing structure or housing of the coke discharge zone includes a longitudinal wall which is erected on, or immediately before, the outer wall of the master gangway of the coke oven battery and it is provided with openings which are aligned with the coke oven chambers. The openings have dimensions corresponding to the cross-sections of the oven chambers and are closable by means of doors, guards, or curtains. During the coke pushing operation, these door, guards or curtains are opened and they are tightly connected to the coke guide car. With such an arrangement, the operators on the wharf look after the coke cake guidance, and the door machine and door cleaning device at a location outside of the roofed area, and are no longer exposed to gases and dusts within the hall.

Experience has shown that within the period of time from the extraction of the doors of the oven chambers containing the carbonized coke up to the beginning of the pushing operation proper, only small emissions occur so that no particular devices are necessary for their interception and evacuation. With the inventive arrangement, the working conditions of the attending personnel are considerably improved and the effect of the hall structure in which the gases and dust accumulate is not smaller than the effect obtained in the known halls which also enclose the coke cake guide zone.

In up-to-date coking plants, unmanned quenching car drives are provided or automatic conveyor belts are used so that, in ordinary cases, there is no need for any attendant being present within the inventive hall structure, except for the maintenance which is required and which is not necessary during normal operation. Advantageously, lids or gates are provided in the outer wall of the hall in its bottom portion, and these open under the action of the discharged coke gliding down the wharf and then they close again after the coke passes through them.

Accordingly, it is an object of the invention to provide an improved roofing structure or housing structure which is arranged to overlie the coke conveying section directly adjacent the gangway of a coke oven battery and which includes its own dust removal and gas removal system and which has at least one wall extending alongside the gangway which is provided with a plurality of openings corresponding in size to the openings of the coke ovens.

A further object of the invention is to provide a coke oven roofing structure which makes it possible for an attendant to observe the operation of the discharge of the glowing coke from each oven battery without it being necessary for the observer to be present within the coke conveying and quenching area after the coke cake is pushed out of the coke cake car and into the quenching car or conveyor.

A further object of the invention is to provide a coke oven battery roofing structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
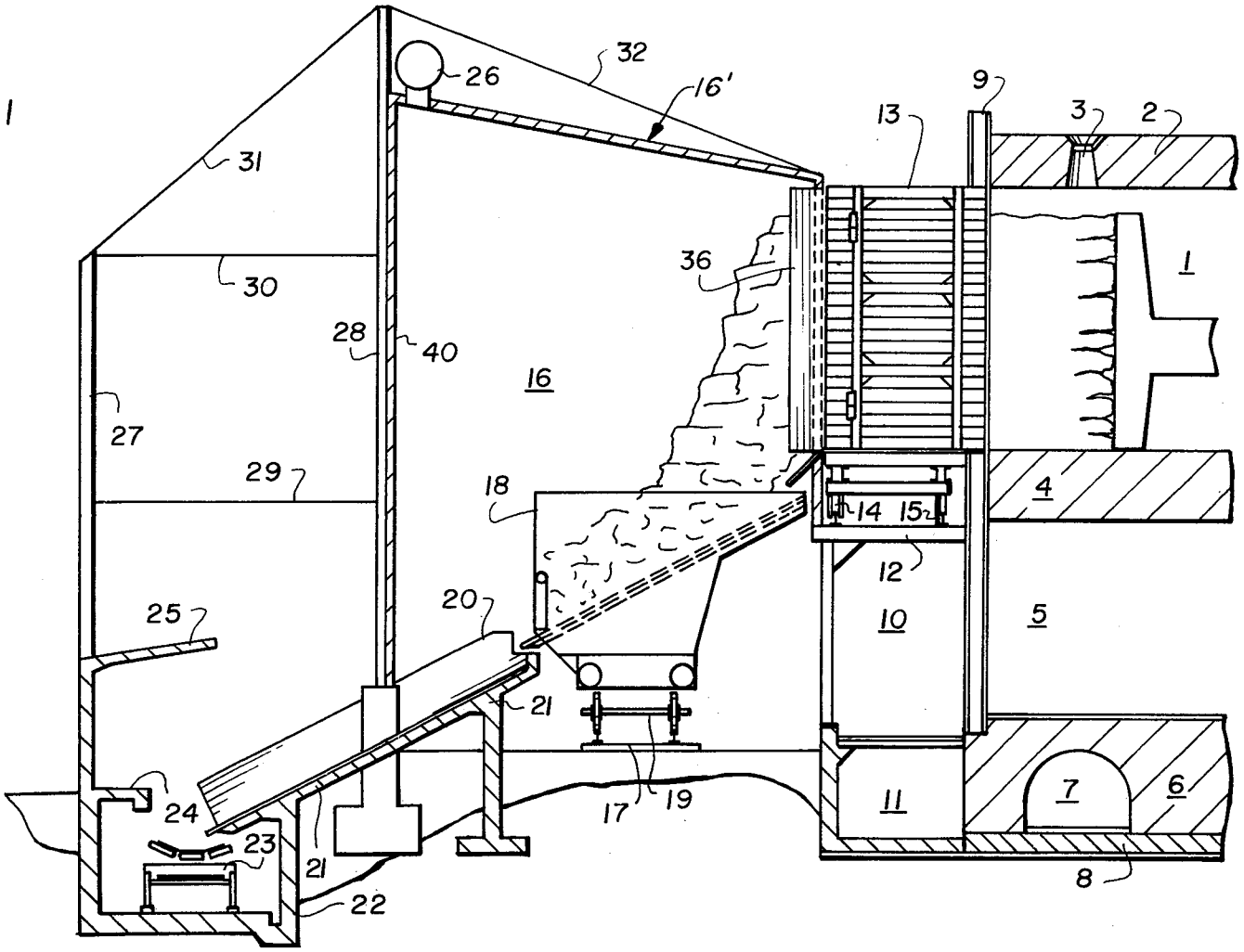
FIG. 1 is a partial transverse sectional view of a coke oven battery having a roofing structure constructed in accordance with the invention.
Figure 2:
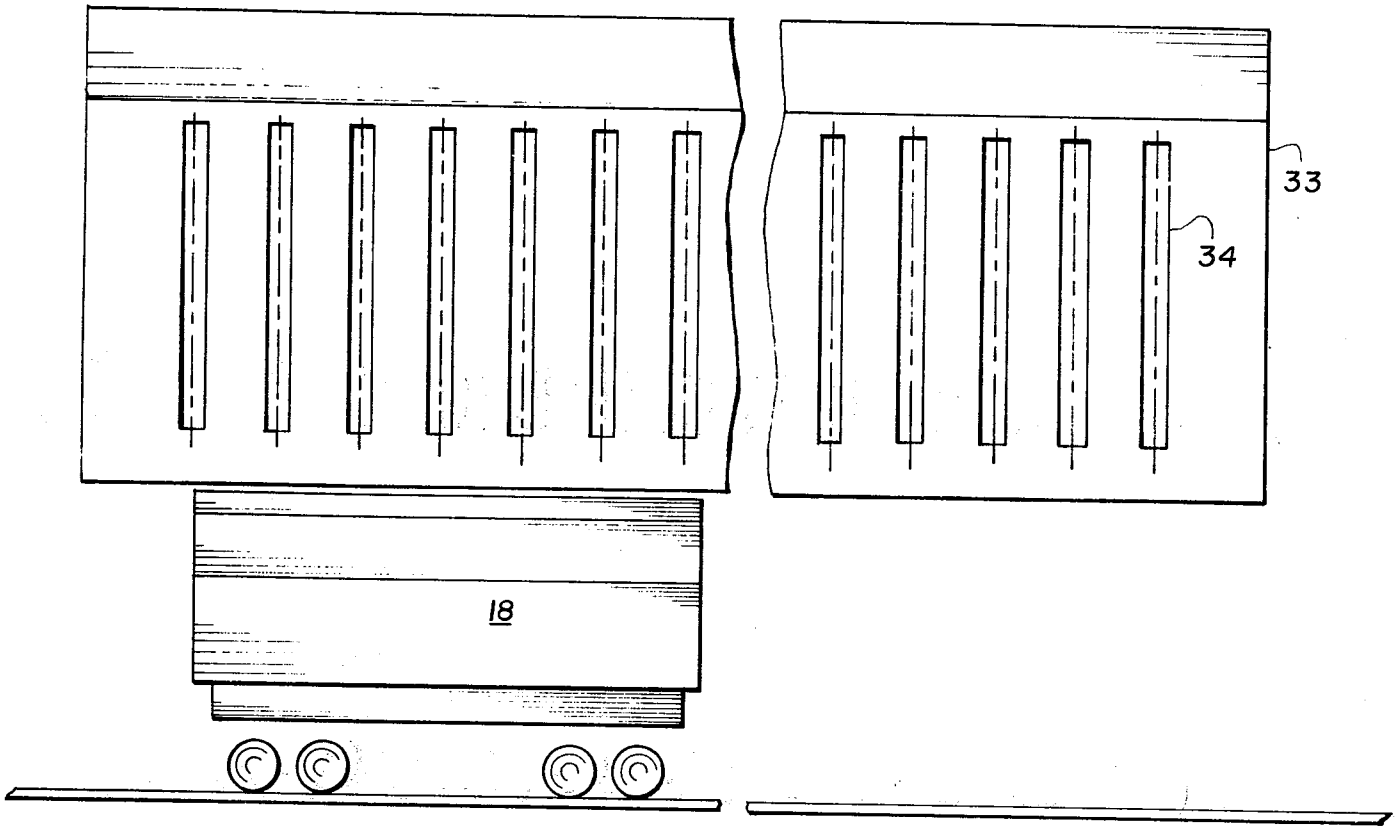
FIG. 2 is a partial interior elevational view of the battery side wall of the roofing structure of the invention.

Referring to the drawings in particular, the invention embodied therein in FIG. 1, comprises a roofing structure for use with a horizontal battery coke oven, which includes individual coke oven chambers 1, having an oven roof 2 with a charging hopper 3 and an oven bottom 4. Below bottom 4 is a regenerative space 5 which is located above a substructure 6 which includes a flue duct 7. The substructure 6 rests on a bottom plate 8 of the battery. An anchoring stay 9 is located at the front end of the battery adjacent a master gangway 10. A piping duct 11 is located below the master gangway. A roof 12 of the master gangway provides a platform on which there is trackway or rails 15 for accomodating wheels 14 of a coke cake guide car 13. Roof structure housing generally designated 16' extends over the entire length of the battery and it is connected to a quenching tower, which is not shown. The roof structure housing 16' covers a track 17 of a quenching car 18 for the glowing coke. The quenching car 18 includes wheel sets 19 to permit it to move over track 17. The quench car trackway 17 is located alongside and below the guide car trackway 15. The interior of the housing defines a quenching track hall 16 which also accommodates the substructure 21 forming a wharf or chute 20 for coke which may be delivered from the quenching car 18. The complete housing structure may also include a channel 22 which accommodates a belt conveyor 23 with a footpath 24 for an operator. This section is also provided with an overhanging roof forming a shed 25.

Roof structure housing 16' is provided with a flue gas offtake system 26 and it is supported by standards 27, 28 and side bracings 29, 30, 31 and 32.

In accordance with a feature of the invention, the roof structure housing 16' includes a front wall 33 adjacent the gangway roof 12 which faces the coke cake guide car 13 and which is provided with openings 34 which are aligned with the oven chambers and which are the same size as the openings for the chambers. In addition, the housing structure 16' includes an outer wall 40 which is spaced from, and parallel to, the inner wall 33 or furnace battery side wall.

The side elevational view of the inner wall 33 of the housing structure 16' shows the arrangement of the openings 34 which will align with the coke oven battery openings.

Figure 3:
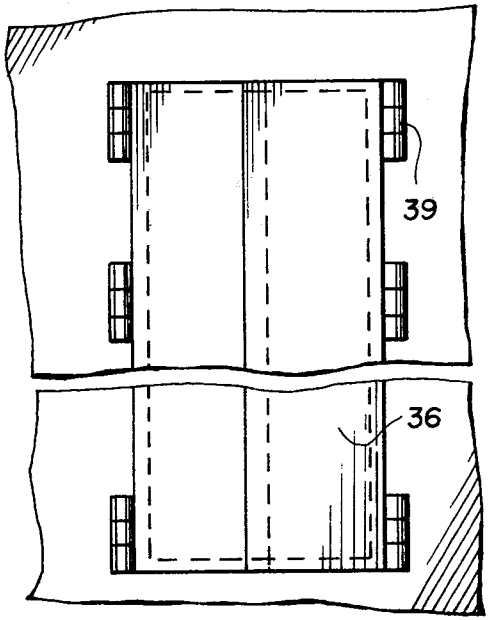
FIG. 3 is a front elevational view of the doors of the battery side wall of the roofing structure.
Figure 4:
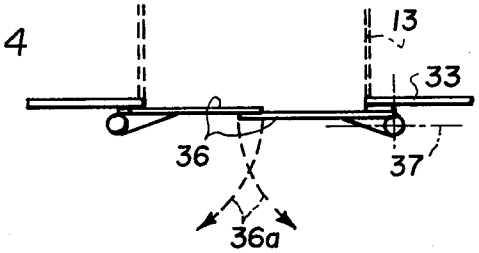
FIG. 4 is a horizontal sectional view of the doors shown in FIG. 3.
Figure 7:
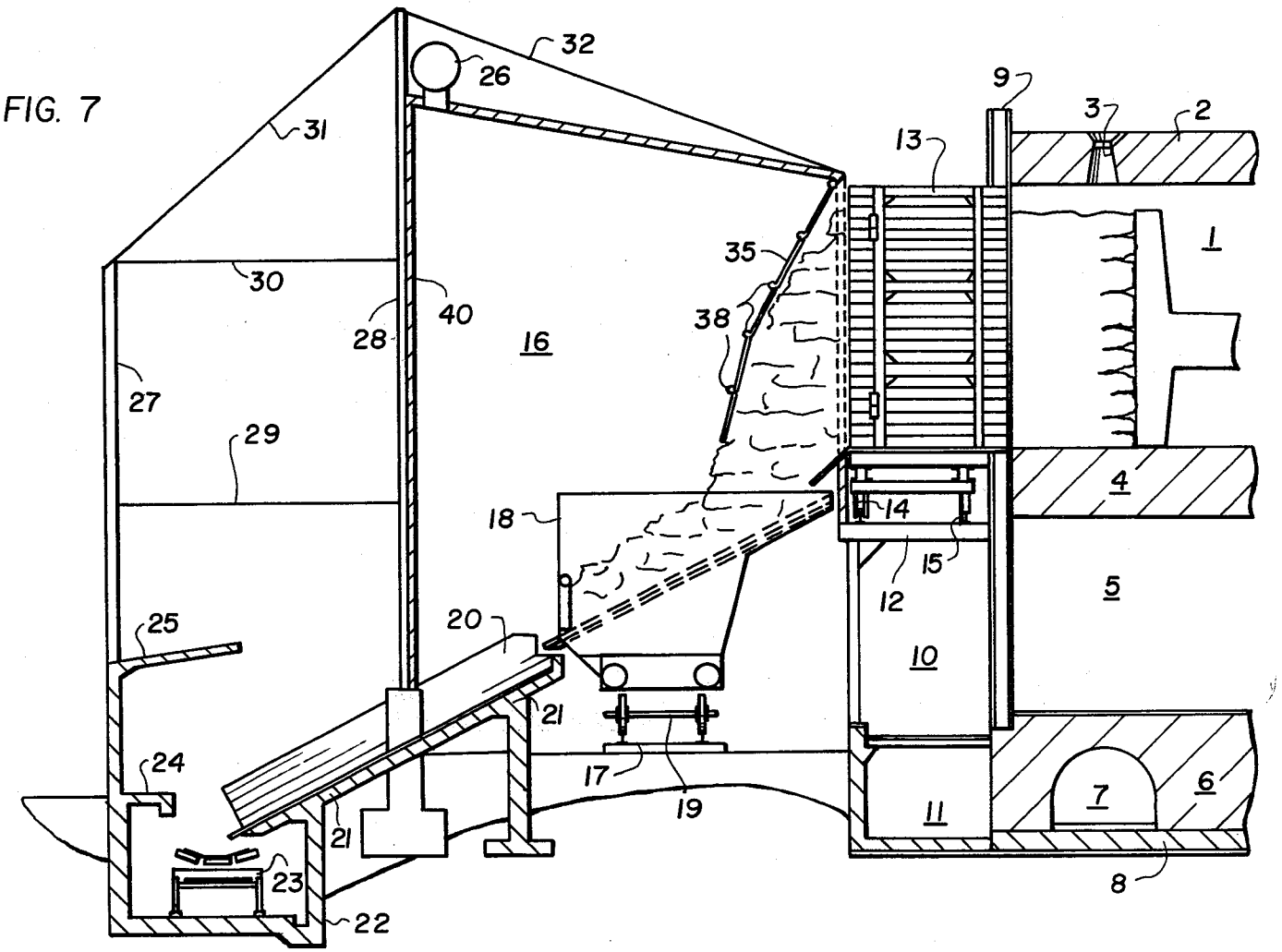
FIG. 7 is a view similar to FIG. 1 showing the embodiment of FIGS. 5 and 6.

FIGS. 3 and 4 indicate the construction in which the openings 34 are closed by door wings 36 which are pivotable about their axes 37. The door wings 36 are adapted to be pushed outwardly by the discharged coke cake or to open automatically upon approaching of the hot coke cake and to close after its passage therethrough. The doors pivot on hinges 39 and the openings of the door wings are indicated by dotted lines **36*a*, as shown in FIG. 4**.

Figure 5:
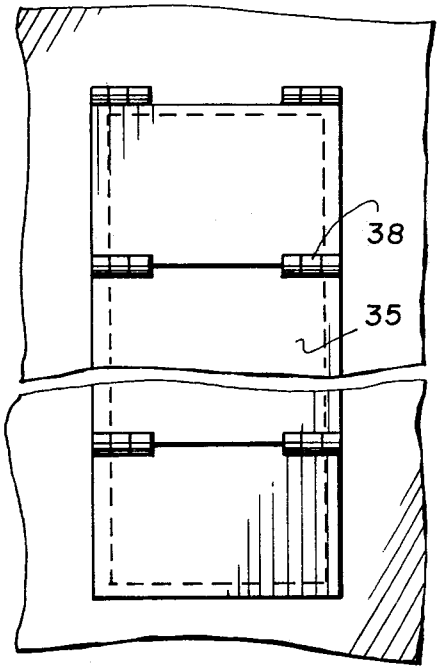
FIG. 5 is a front elevational view similar to FIG. 3 of another embodiment of the invention.
Figure 6:
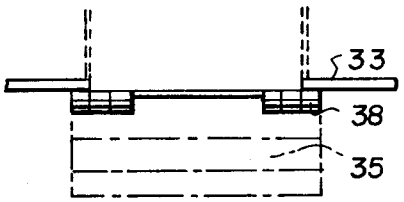
FIG. 6 is a partial sectional view of the embodiment shown in FIG. 5.

In the embodiment shown in FIGS. 5 and 6, instead of the two doors 36, 36, there is a guard 35 which is made of cast iron and which is supported on hinges 38.

While a specific embodiment of the invention has been shown and described in detail to illustrate the application of the principles of the invention, it will be understood that the invention may be embodied otherwise without departing from such principles.

What is claimed is:

1. A structure for use with a coke oven battery having a plurality of horizontally arranged ovens each of which has an opening through which glowing coke may be pushed and which is associated with a quenching station for quenching the glowing coke and which has a housing associated with the station for the offtake of coke gases, comprising a master gangway extending horizontally alongside the battery of ovens, a guide car trackway along which a coke guide car is movable extending along said gangway, a coke cake guide car movable along said guide car trackway and having an opening on one side alignable with each oven opening in succession for receiving the flowing coke therefrom and having an opposite side with a discharge opening, a quench car trackway for the coke extending alongside and below the guide car trackway, a quench car movable along said quench car trackway to and from the quenching station, said housing extending over the length of said oven battery and having an inner wall adjacent said gangway and positioned between said gangway and said quench car trackway extending over the length of said oven battery, said inner wall facing the discharge opening of said coke cake guide car and the coke ovens with a plurality of horizontally spaced openings corresponding in number, size and arrangement to the openings of said coke ovens and the discharge opening of said guide car, said housing having a roof extending from said inner wall over the quench car trackway and enclosing said trackway overall of said oven up to said quenching station with the height of the roof being above the guide car, and means associated with said housing for the offtake of gases, said housing including an outer wall spaced from and parallel to said wall adjacent said gangway, said outer wall having a chute extending therethrough alignable with one side of said coke quench car at least along one position of its travel along said quench car trackway, and a coke conveyor for conveying quenched coke located alongside the discharge of said chute in a position to receive the quenched coke and to transport it away.

2. A structure for use with a coke oven battery, according to claim 1, wherein the openings of said wall adjacent the gangway are closed by door wings which are pivoted at each side of the openings.

3. A structure according to claim 1, wherein said coke quench car includes a side facing the coke oven which is laterally elongated to receive the glowing coke and which includes an opposite side with a discharge alignable with the chute for the discharge of the glowing coke from the car after it has been quenched.

4. A structure according to claim 1, including a shed enclosing said quenched coke conveyor exteriorly of said housing.

5. A structure for use with a coke oven battery, according to claim 1, wherein the openings in said wall adjacent the gangway are closeable by means of guards.

* * * * *